US008007017B2

(12) United States Patent
Farrell

(10) Patent No.: US 8,007,017 B2
(45) Date of Patent: Aug. 30, 2011

(54) STRIKER PLATE, A DOOR JAMB ASSEMBLY AND A METHOD OF SECURING A STRIKER PLATE TO A DOOR SURROUND STRUCTURE

(75) Inventor: Shelly Ellen Farrell, Cobh (IE)

(73) Assignee: Assa Abloy New Zealand Limited, Albany (NZ)

( * ) Notice: Subject to any disclaimer, the term of this patent is extended or adjusted under 35 U.S.C. 154(b) by 0 days.

(21) Appl. No.: 11/901,641

(22) Filed: Sep. 17, 2007

(65) Prior Publication Data

US 2008/0067819 A1 Mar. 20, 2008

(30) Foreign Application Priority Data

Sep. 18, 2006 (NZ) ..... 549914

(51) Int. Cl.
*E05B 15/02* (2006.01)

(52) U.S. Cl. ..... 292/341.15; 292/341.19

(58) Field of Classification Search ..... 292/341.15, 292/340, 341.18, 341.19, 80, DIG. 61; 49/504, 49/505, 190
See application file for complete search history.

(56) References Cited

U.S. PATENT DOCUMENTS

| | | | | | |
|---|---|---|---|---|---|
| 3,257,139 | A * | 6/1966 | Russell et al. | ..... | 292/341.18 |
| 3,361,466 | A * | 1/1968 | Russell et al. | ..... | 292/341.18 |
| 3,416,828 | A * | 12/1968 | Russell et al. | ..... | 292/341.18 |
| 3,506,293 | A * | 4/1970 | Armstrong et al. | ..... | 292/341.19 |
| 3,774,345 | A * | 11/1973 | Cole et al. | ..... | 49/504 |
| 4,288,120 | A * | 9/1981 | Moore | ..... | 292/341.18 |
| 4,453,752 | A * | 6/1984 | McKann | ..... | 292/341.19 |
| 4,614,068 | A * | 9/1986 | Bergthold | ..... | 52/211 |
| 6,491,326 | B1 * | 12/2002 | Massey et al. | ..... | 292/162 |

* cited by examiner

*Primary Examiner* — Carlos Lugo
*Assistant Examiner* — Mark Williams
(74) *Attorney, Agent, or Firm* — DeLio & Peterson, LLC

(57) ABSTRACT

A striker plate having projections such that when the striker plate is inserted into a door surround structure the projections provide sufficient biasing to retain the striker plate in a desired lateral and vertical location whilst it is secured to the door surround structure. The projections are preferably integrally formed resilient elements adapted to engage with grooves in walls of a door surround structure. An adjustment mechanism may also be provided to adjust the spacing of the striker plate from a door surround structure.

16 Claims, 2 Drawing Sheets

STRIKER PLATE, A DOOR JAMB ASSEMBLY AND A METHOD OF SECURING A STRIKER PLATE TO A DOOR SURROUND STRUCTURE

This invention relates to a striker plate and more particularly a striker plate for a door.

The invention also relates to a door jamb assembly and to a method of securing a striker plate to a door surround structure.

The lock bolt(s) of a door lock will generally engage in a striker plate mounted with part of the door surround (frame). It is well recognised that it is important for security and weather tightness that the locking bolt(s) of a door lock engage correctly with the apertures in the striker plate. The striker plate is conventionally mounted to the door frame and the locking bolt can be part of a door lock which might be surface mounted or morticed into the door.

To provide for adjustment of the position of the striker plate to achieve the correct engagement of the locking bolt(s) with the aperture(s) of the striker plate, it is not uncommon for lock manufacturers to provide a degree of adjustment in one direction in the striker plate. Conventionally this is achieved through slotted screw holes and the like. This enables the striker plate to be positioned approximately and then finally adjusted to a correct position.

Usually the initial approximate positioning requires the installer to hold the striker plate in position whilst marking the door frame or drilling the fixing holes.

The striker plate, however, often has to be positioned in two directions namely, laterally and vertically. Adjustment provided in the striker plate is usually provided in the vertical direction only. It is, therefore, not uncommon for the installer to place the striker plate so far out of position that the adjustment provided is insufficient to enable the striker plate to be set in a correct position.

An object of the present invention is thus to provide a striker plate which provides more accurate positioning of the striker plate in lateral and vertical positions when being mounted to a door frame or to at least provide the public with a useful choice.

Broadly according to one aspect of the present invention there is provided a striker plate including:

a. one or more openings to receive one or more lock bolts of a lock;
b. apertures facilitating mounting of the striker plate to a door surround structure; and
c. at least first and second oppositely disposed projections configured to be engageable with parts of a door surround structure, at least one of the projections being biased to enable the striker plate to temporarily engaged in a door surround structure and retained in position prior to final fixing of the striker plate to the door surround structure.

According to a further aspect there is provided a door jamb assembly comprising:

a. a door surround structure having a recess for receiving a striker plate with grooves provided in walls of the door surround structure surrounding the recess; and
b. a striker plate including:
   i. one or more openings to receive one or more lock bolts of a lock;
   ii. apertures facilitating mounting of the striker plate to a door surround structure; and
   iii. at least first and second oppositely disposed projections engaged with the grooves of the door surround structure, at least one of the projections being biased to enable the striker plate to be temporarily engaged in a door surround structure and retained in position prior to final fixing of the striker plate to the door surround structure.

According to another aspect of the invention there is provided a method of securing a striker plate to a door surround structure, the method comprising the steps of:

a. providing a striker plate including:
   i. one or more openings to receive one or more lock bolts of a lock;
   ii. apertures facilitating mounting of the striker plate to a door surround structure; and
   iii. at least first and second oppositely disposed projections configured to be engageable with parts of a door surround structure, at least one of the projections being biased to enable the striker plate to be temporarily engaged in a door surround structure and retained in position prior to final fixing of the striker plate to the door surround structure;
b. inserting the striker plate in the recess in the door surround structure so that the projections are biased against parts of the door surround so that the striker plate is retained in position by the projections; and
c. fixing the striker plate to the door surround structure.

In the following more detailed description of the invention, according to one preferred embodiment, reference will be made to the accompanying drawings in which the striker plate is illustrated in conjunction with a door frame section, the drawings including:

Figure 2:
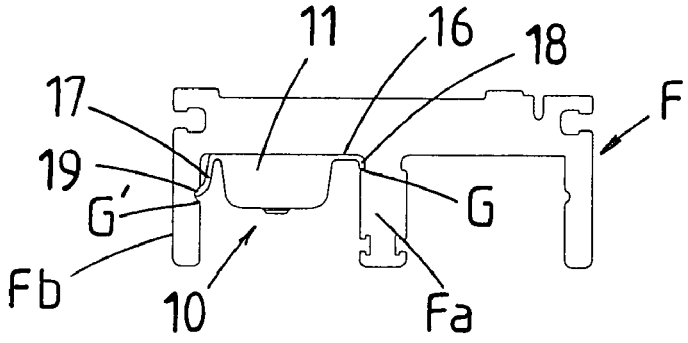
FIG. 2 shows a top plan view of the arrangement shown in FIG. 1.
Figure 1:
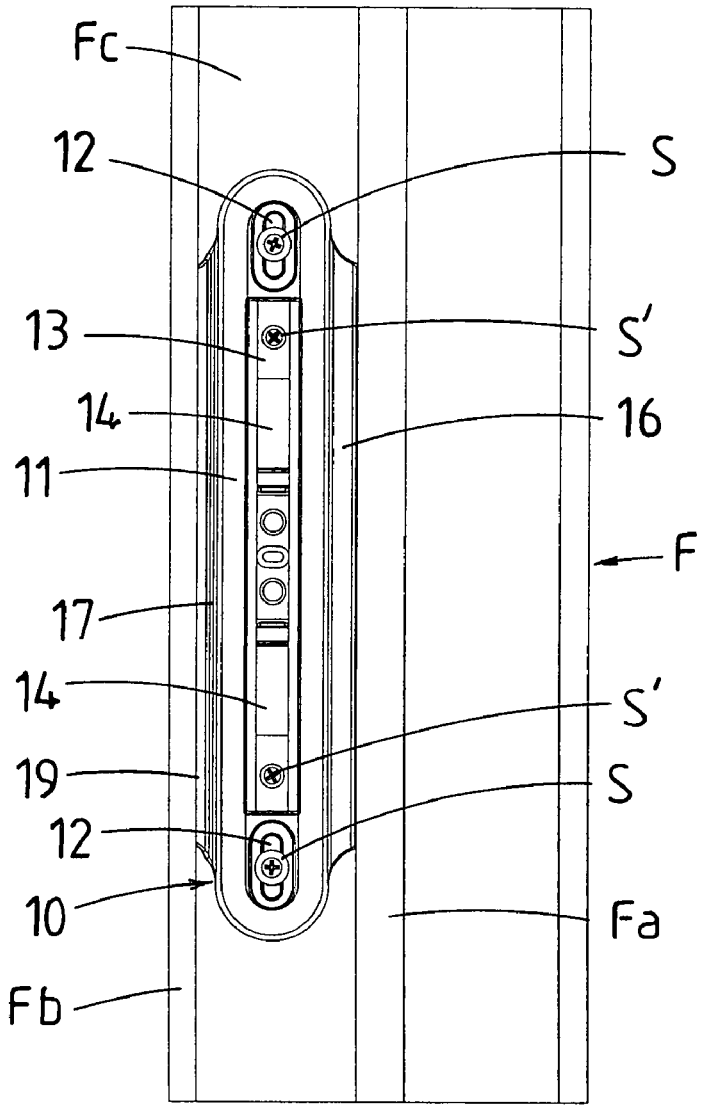
FIG. 1 shows a front view of the striker plate and part of the door frame section.
Figure 3:
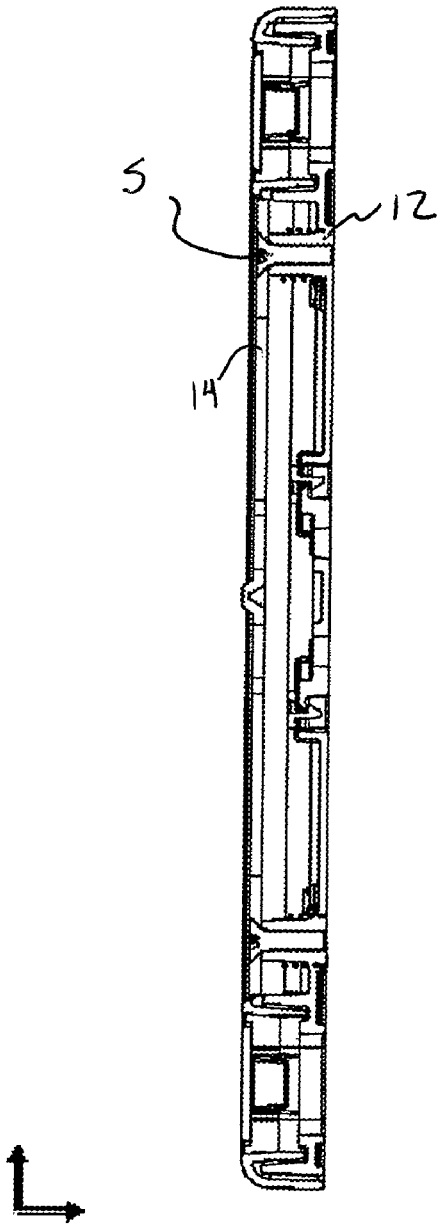
FIG. 3 shows a side plan view of the arrangement shown in FIG. 1.

The striker plate as illustrated and referred to herein is one form that a striker plate may take. Thus, as disclosed, it is in the form of an assembly that includes a body 11 which has at or toward each end means for fixed mounting, namely an elongate mounting slot 12. These slots 12 are aligned and are disposed on a longitudinal axis of the body 11. Screws S can be engaged through the slots to fix the striker plate in a final fixed mounted position.

The body 11, in the illustrated form of striker plate 10, includes elongate mounting slot 12. An insert 13 in the body 11 is located adjacent elongate mounting slot 12. Thus, insert 13 includes one or more openings or apertures 14 with which the bolt(s) of a lock (not shown) can engage.

It will be appreciated by those skilled in the art that a striker plate can take different forms to that described above and illustrated in the drawings. The actual configuration of the body 11, and the manner in which the lock bolt apertures 14 are provided, can vary from manufacturer to manufacturer. Also, different arrangements of elongate slots providing for vertical adjustment of the position of the striker plate 10 can be provided. The arrangement, as illustrated, is therefore by way of example only.

The striker assembly 10 is provided with a first projection 16 from one side of body 11 and a second projection 17 from the other side. These projections 16 and 17 engage with the door surround structure more commonly referred to as a frame F. The projections 16 and 17 thus locate and hold the striker assembly 10 in its lateral position so as to provide a means of positioning the striker assembly 10 accurately in the lateral direction. As well they hold the striker plate 10 in position vertically while the fasteners, such as fixing screws S, are inserted through the elongate slots 12 (or other similar formations).

One or both of the projections 16 and 17 may be biased outwardly. In a preferred form of the invention one or both of the projections 16 and 17 are resilient or exhibit resilience. The projection thus has the effect of being "spring loaded". This spring loading can be achieved by virtue of the form of construction used to form the projection and/or its disposition relative to the body 11. The projection can be coupled to the body 11, or to the insert 13, or in some other manner, formed as a separate component of the overall assembly of the striker plate 10 and be suitably biased relative thereto.

In the illustrated form of the invention, the projections 16 and 17 are formed integrally as a unit part of the body 11. This provides a convenient form of manufacture and keeps down the number of individual components making up the striker assembly 10.

In the illustrated form of the invention projection 16 is essentially flat and projects laterally from the body 10. The distal edge is formed as an upturned edge or tip 18.

In this form of the invention the other projection 17 inclines upwardly and away from the base of the housing 10 and is, therefore, formed so as to have a degree of resilience or springiness i.e. is effectively "spring loaded". This projection 17 terminates at its distal edge in a slightly curved edge portion 19.

As can be seen in FIG. 2, the projections 16 and 17 preferably locate in grooves or indentations G and G' in parts Fa and Fb of the door frame F. The upturned edge 18 fits into groove G while the curved distal edge 19 engages in the groove G'.

The spring loading of the projection 17 thus, not only enables the body 11 with projections 16 and 17 to be forced into place between parts Fa and Fb but also has the effect of wedging or holding the body 11 in place in the door frame F. The projections 16 and 17, therefore, hold the strike assembly in a lateral position as well as in an adjusted vertical position. The fixing screws S can thus inserted to fix the striker assembly 10 in the correction position.

With the striker plate, as illustrated in the drawings, adjustment in the third axis is also possible. The insert 13 is held against screws S' (which mount the insert 13) by springs (not shown). Hence the position of the insert 13 relative to the surface Fc of frame F against which the body 11 is mounted can be adjusted.

It will be appreciated by those skilled in the art that the embodiment, as described herein and illustrated, shows a striker assembly for a sliding door. However, it will be appreciated that the concept can also be applied to a hinged door.

It will be appreciated by those skilled in the art that the striker plate is open to modification. For example, the projections 16 and 17 can take different forms to accommodate different types of door frame sections. Also, while in the preferred embodiment, a single projection 16 and 17 is provided at each longitudinal side of the elongate body 11, this is only one embodiment and a series of individual projections, lugs, flanges or the like could be provided on one or both sides of the striker plate assembly 10. Alternatively, the body 10 could be formed to engage a flange of the frame section F and a single (or plurality) of projections be used to engage another flange or part of frame F to wedge the striker plate in place.

Other modifications within the scope of the present invention will be apparent to those skilled in the art.

The invention claimed is:

1. A striker plate comprising:

a. a body including an insert with one or more openings, each of the one or more openings adapted to receive a respective lock bolt from a lock having one or more lock bolts;

b. the body includes at least two vertically oriented elongate mounting slot apertures facilitating mounting of the striker plate to a door surround structure, the at least two vertically oriented elongate mounting slot apertures receiving corresponding mounting screws for final fixing of the body in a desired vertical position relative to the door surround structure to vertically position the one or more openings of the insert relative to the lock bolt; and c. the body further includes at least first and second oppositely disposed projections projecting outward substantially in a plane parallel to a plane defined by the insert, each of the oppositely disposed projections projecting outward a corresponding lateral projection distance and the projections being configured to be engageable with corresponding oppositely positioned grooves in the door surround structure for holding the body in the door surround structure, the lateral projection distances of the projections acting to laterally position the body to a desired lateral position and prevent further lateral motion relative to the door surround structure, wherein at least one of the projections is resiliently movable relative to its corresponding groove and is engaged with said corresponding groove, which enables the body to be temporarily engaged and moved to the desired vertical position relative to the door surround structure and temporarily retained in the desired vertical position prior to final fixing of the striker plate to the door surround structure, the engagement between the first and second oppositely disposed projections and the corresponding of oppositely positioned grooves avoiding any requirement of an installer holding the striker plate in position as the striker plate is finally fixed in the desired vertical position.

2. A striker plate as claimed in claim 1 wherein both projections have resilience relative to their corresponding oppositely positioned grooves sufficient to retain the striker plate when engaged with a door surround structure.

3. A striker plate as claimed in claim 1 wherein the projections are integrally formed with the striker plate.

4. A striker plate as claimed in claim 1 wherein the striker plate has a base which abuts a door surround structure and wherein the first projection extends laterally from the base.

5. A striker plate as claimed in 4 wherein the distal end of the first projection has an upturned edge.

6. A striker plate as claimed in claim 1 wherein the striker plate has a base which abuts a door surround structure and wherein the second projection extends upwardly and away from the base.

7. A striker plate as claimed in 6 wherein the distal end of the second projection has an outwardly curved edge.

8. A striker plate as claimed in claim 1 wherein the apertures are elongate apertures provided in the striker plate to accommodate fasteners to secure the striker plate to a door surround structure.

9. A door jamb assembly comprising:

a. a door surround structure having a recess for receiving a striker plate with grooves provided in walls of the door surround structure surrounding the recess; and b. a striker plate including:

i. a body includes an insert with one or more openings, each of the one or more openings adapted to receive a respective lock bolt from a lock having one or more lock bolts;

ii. the body includes at least two vertically oriented elongate mounting slot apertures facilitating mounting of the striker plate to a door surround structure, the at least two vertically oriented elongate mounting slot apertures receiving corresponding mounting screws for final fixing of the body in a desired vertical position relative to the door surround structure to vertically position the one or more openings of the insert relative to the lock bolt; and iii. the body further includes at least first and second oppositely disposed projections projecting outward substantially in a plane parallel to a plane defined by the insert, each of the oppositely disposed projections projecting outward a corresponding lateral projection distance and the projections being engaged with corresponding ones of the grooves of the door surround structure for holding the body in the door surround structure, the lateral projection distances of the projections acting to laterally position the body to a desired lateral position and prevent further lateral motion relative to the door surround structure, wherein at least one of the projections is resiliently movable relative to its corresponding groove and is engaged with said corresponding groove, which enables the body to be temporarily engaged and moved to the desired vertical position relative to the door surround structure and retained in the desired vertical position prior to final fixing of the striker plate to the door surround structure, the engagement between the first and second oppositely disposed projections and the corresponding oppositely positioned grooves avoiding any requirement of an installer holding the striker plate in position as the striker plate is finally fixed in the desired vertical position.

10. A door jamb assembly as claimed in claim 9 wherein both projections have resilience sufficient to retain the striker plate when engaged with a door surround.

11. A door jamb assembly as claimed in claim 9 wherein the projections are integrally formed with the striker plate.

12. A door jamb assembly as claimed in claim 9 wherein the striker plate has a base which abuts a door surround structure and wherein the first projection extends laterally from the base.

13. A door jamb assembly as claimed in 12 wherein the distal end of the first projection has an upturned edge.

14. A door jamb assembly as claimed in claim 9 wherein the striker plate has a base which abuts a door surround structure and wherein the second projection extends upwardly and away from the base.

15. A door jamb assembly as claimed in claim 14 wherein the distal end of the second projection has an outwardly curved edge.

16. A method of securing a striker plate to a door surround structure, the method comprising the steps of:

a. selecting a striker plate comprising:

i. a body including an insert with one or more openings, each of the one or more openings adapted to receive a respective lock bolt from a lock having one or more lock bolts;

ii. the body of the selected striker plate includes at least two vertically oriented elongate mounting slot apertures facilitating mounting of the striker plate to a door surround structure, the at least two vertically oriented elongate mounting slot apertures receiving corresponding mounting screws for final fixing of the body in a desired vertical position relative to the door surround structure to vertically position the one or more openings of the insert relative to the lock bolt; and iii. the body of the selected striker plate further includes at least first and second oppositely disposed projections corresponding to the door surround structure and projecting outward substantially in a plane parallel to a plane defined by the insert, each of the oppositely disposed projections projecting outward a corresponding lateral projection distance and the projections being configured to be engageable with corresponding oppositely positioned grooves in the door surround structure for holding the body in the door surround structure, the lateral projection distances of the projections acting to laterally position the body to a desired lateral position and prevent further lateral motion relative to the door surround structure and, wherein at least one of the projections is resiliently movable relative to its corresponding groove and is engaged with said corresponding groove, which enables the body to be temporarily engaged and moved to the desired vertical position relative to the door surround structure and temporarily retained in position prior to final fixing of the striker plate to the door surround structure, the engagement between the first and second oppositely disposed projections and the corresponding oppositely positioned grooves avoiding any requirement of an installer holding the striker plate in position as the striker plate is finally fixed in the desired vertical position, b. inserting the selected striker plate in the recess in the corresponding door surround structure so that the projections are engaged with and biased against the corresponding oppositely positioned grooves in the door surround structure so that the striker plate is permanently fixed in the desired lateral position by the projections and temporarily retained in a vertical position by the projections, the projections permitting vertical slidable motion of the selected striker plate with respect to the door surround structure;

c. adjusting the vertical position of the striker plate by sliding the striker plate to the desired vertical position, and d. final fixing the striker plate to the door surround structure to prevent further vertical motion of the striker plate relative to the door surround structure.

* * * * *